United States Patent [19]

Palm et al.

[11] 4,168,035

[45] Sep. 18, 1979

[54] APPARATUS FOR CRUSHING STUMPS AND OTHER FELLING WASTE INTO CHIPS

[76] Inventors: Roland Palm, 346 Mobodarna; Sven Palm, 16 Krongatan, both of 826 00 Söderhamn, Sweden

[21] Appl. No.: 854,011

[22] Filed: Nov. 22, 1977

[51] Int. Cl.[2] ..... B02C 18/18; B02C 18/22

[52] U.S. Cl. ..... 241/81; 144/2 N; 144/172; 241/101.7; 241/243; 241/261

[58] Field of Search ..... 241/28, 81, 101.7, 222, 241/223, 224, 243, 244, 261; 144/2 D, 3 D, 178, 174, 175; 198/771; 209/393

[56] References Cited

U.S. PATENT DOCUMENTS

| | | | |
|---|---|---|---|
| 817,382 | 4/1906 | Merrill | 144/172 UX |
| 2,812,859 | 11/1957 | Frank | 209/393 |
| 2,974,795 | 3/1961 | Behnke et al. | 209/393 X |
| 3,285,305 | 11/1966 | Nicholson | 144/3 D X |
| 3,356,116 | 12/1967 | Brundell et al. | 241/101.7 X |
| 4,077,450 | 3/1978 | Ackerman | 144/172 |

FOREIGN PATENT DOCUMENTS

| | | | |
|---|---|---|---|
| 312758 | 11/1971 | U.S.S.R. | 241/222 |

*Primary Examiner*—Howard N. Goldberg
*Attorney, Agent, or Firm*—Holman & Stern

[57] ABSTRACT

A mill for crushing tree trunks is disclosed which includes a rotor having a series of crushing blades disposed helically around the rotor. The rotor blades pass between axially spaced stator blades in the mill housing to crush the trunks and liberated associated foreign matter. The crushed material and liberated foreign matter is moved toward one end of the mill housing by the action of the helically disposed rotor blades where it is discharged from the mill.

6 Claims, 5 Drawing Figures

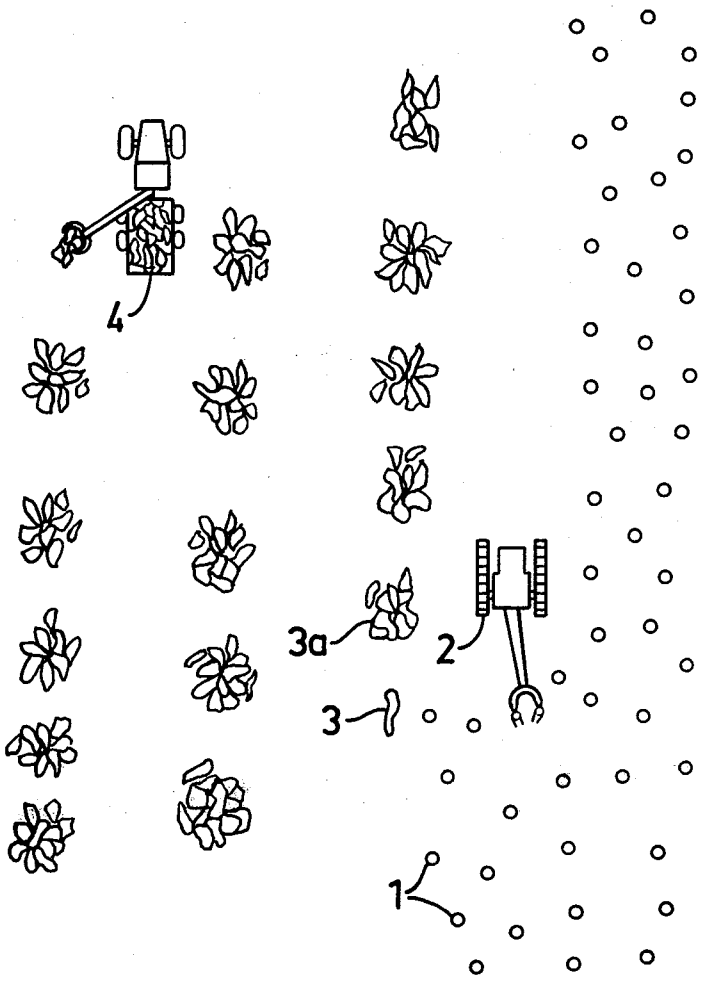
FIG.1
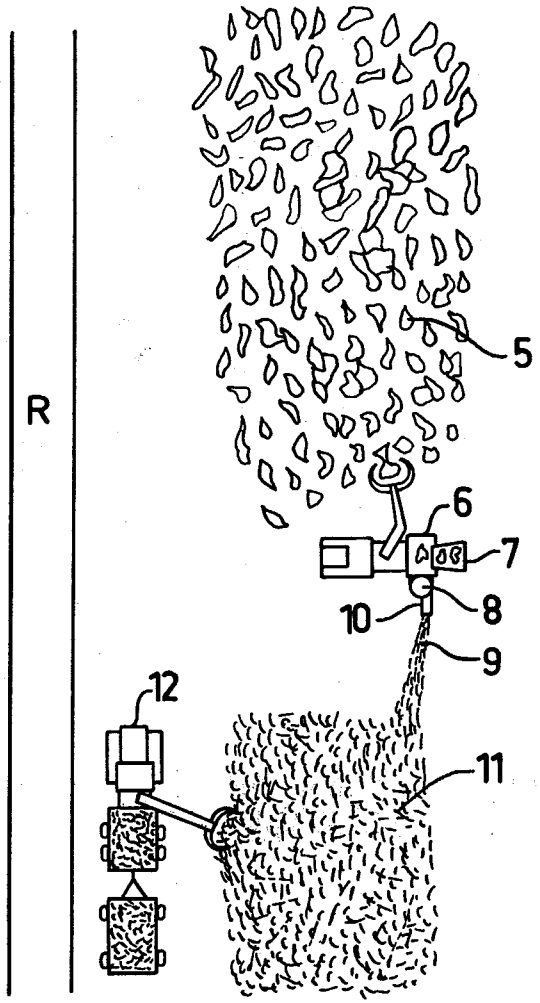

APPARATUS FOR CRUSHING STUMPS AND OTHER FELLING WASTE INTO CHIPS

BACKGROUND OF THE INVENTION

The present invention relates to an apparatus for crushing stumps and other felling waste into chips.

Owing to an increasing shortage of wood fibre raw material in forests in relation to the increasing demand in the world, the wood countries have for the last years tried to utilize a greater part of the tree than had earlier been the case. In this respect the attention has particularly been directed to the tree stumps, mainly since the stumps and also the roots give an essential wood fibre addition of high pulp quality. A number of devices for stump removal (stump extraction) have been developed. In connection with or after the removal of the stump out of the ground a first dividing of the stump is carried out in order to make it together with its root system more readily workable.

The divided stumps have up to now been transported on a cross-country transport vehicle to a central location adjacent a road, from which location the further transport up to cellulose factories has been made by motor lorries or trucks. In the cullulose factories the stumps have been treated in different ways in order to remove earth and stones prior to the machining into chips. Above all two disadvantages, however, exist by such a transport and chipping. One disadvantage is that the stump portions with their projecting roots do not give a solid mass percentage that is sufficiently profitable for the load volume of the transport vehicles. The second disadvantage is the relatively large quantity of earth and stones in the irregularities and projections of the stumps. Also ingrown stones exist. The cellulose factories only allow a small part of these impurities to be present on the stumps upon delivery to the factory.

SUMMARY OF THE INVENTION

An apparatus according to the invention substantially eliminates both these disadvantages and the invention is accordingly an important link in the total work for utilizing the fibre raw material of the stumps. By using an apparatus according to the invention not only stumps can be utilized but also felling waste such as branches, limbs, tops. According to the invention the disintegration takes place out in the terrain in connection with stump extraction wherein simultaneously stones and other impurities in the stumps are removed so that chips substantially free from impurities are obtained.

The characterizing features of the invention in order to eliminate the above mentioned disadvantages and obtain chips free from impurities are set forth in the claims.

BRIEF DESCRIPTION OF DRAWINGS

An embodiment of the invention is by way of example described in the following with reference to the accompanying drawings in which:

FIG. 1 illustrates a process from stump extraction to vehicle transport of finished crushed chips.

FIG. 1 illustrates schematically a process for collecting stumps and for crushing the stumps into chips before truck transport to a cellulose factory or a heating plant for wood burning. The stumps 1 are extracted from the ground and cut into two to four parts by a stumper 2 in a manner known per se. The stumper puts down the stump parts 3 in stacks 3*a* in a row-like system. A stump forwarder 4 then transports, in respect of time unfettered by the operation of the stumper, the stump parts to a central stump stock 5 at a place adjacent a road R. An apparatus according to the invention is located adjacent the stump stock 5. The apparatus, which likewise as to its operation in respect of time is unfettered by other machines, comprises a stump crush mill 6 provided with vibrating stone-separating feed table 7. The stump crush mill 6 disintegrates the stump parts 3 into crush chips. A stone-separating blow device 8 for the chips is arranged at the out-feed end of the crush mill in such a manner, that the chips are blown out in controlled direction by a blow nozzle 10, whereby the chips can form a pile 11 which in view of space can be considerably high relative to its spreading on the ground. The piled chips 11 are fetched by for instance a truck 12 which transport the chips to a factory or other user.

FIGS. 2 and 3 show more in detail an apparatus according to the invention. The stump parts 3 are placed on the feed table 7 by a loading device (not shown) and the feed table 7 is vibrated in vertical direction. Owing to the fact that the feed table, as shown, is inclined towards the in-feed funnel 13 of the crush mill 6, the stump parts 3 will be successively moved towards the funnel 13 and fall down on a mill rotor 14 arranged at the bottom of the funnel 13. The mill rotor is provided with helically spaced rotor blades 15, which engage the stump parts 3 and crush them against counter tools stator blades 16 so that chips are obtained. As shown in the drawings the stator blades are spaced axially along the mill housing and the rotor blades pass therebetween on rotation of the rotor. Owing to the cutting edge form of the rotor blades and the helical location thereof on the rotor 14 the chips are fed along a cylindrical rotor house 17 adapted to the form of the rotor blades 15 and out into an outfeed device 18. The outfeed device 18 feeds the chips into the blow device 8, which according to the conventional blow trap principle separates heavier particles (in this case stone splinters passing the mill 6) and blows the chips to the stone-free pile 11.

Course and external stones as well as earth have already been removed from the stump parts 3 when they pass over the feed table 7. During the vibration of the feed table in order to feed the stumps parts into the mill, stones and earth are shaked off and fall down to the ground between the latticed bars 19 forming the feed table 7 and arranged along the feed direction.

For the drive the mill can be provided with a combustion motor 20, if the mill is to be mobile. The mill can, however, alternatively be provided with an electric motor in case the plant shall be stationary. In a mobile embodiment the mill can alternatively be placed for instance on a trailer, a truck, a forwarder or the like for increased mobility and capacity.

Figure 3:
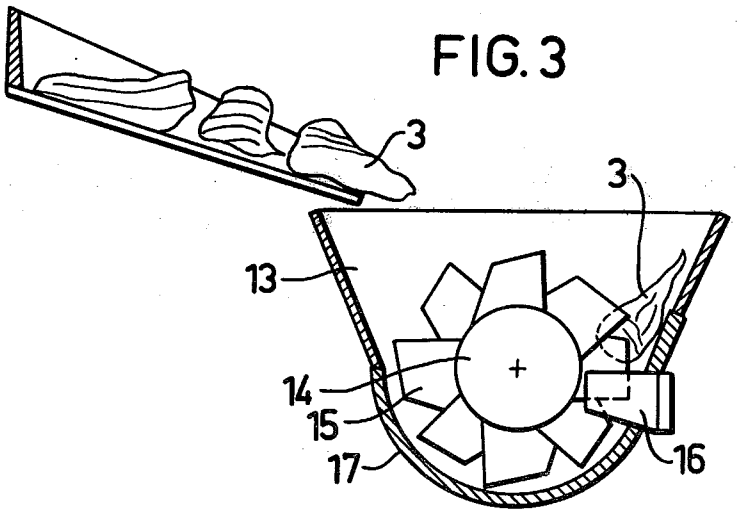
FIG. 3 shows the apparatus of FIG. 2 along section III—III in FIG. 2.
Figure 2:
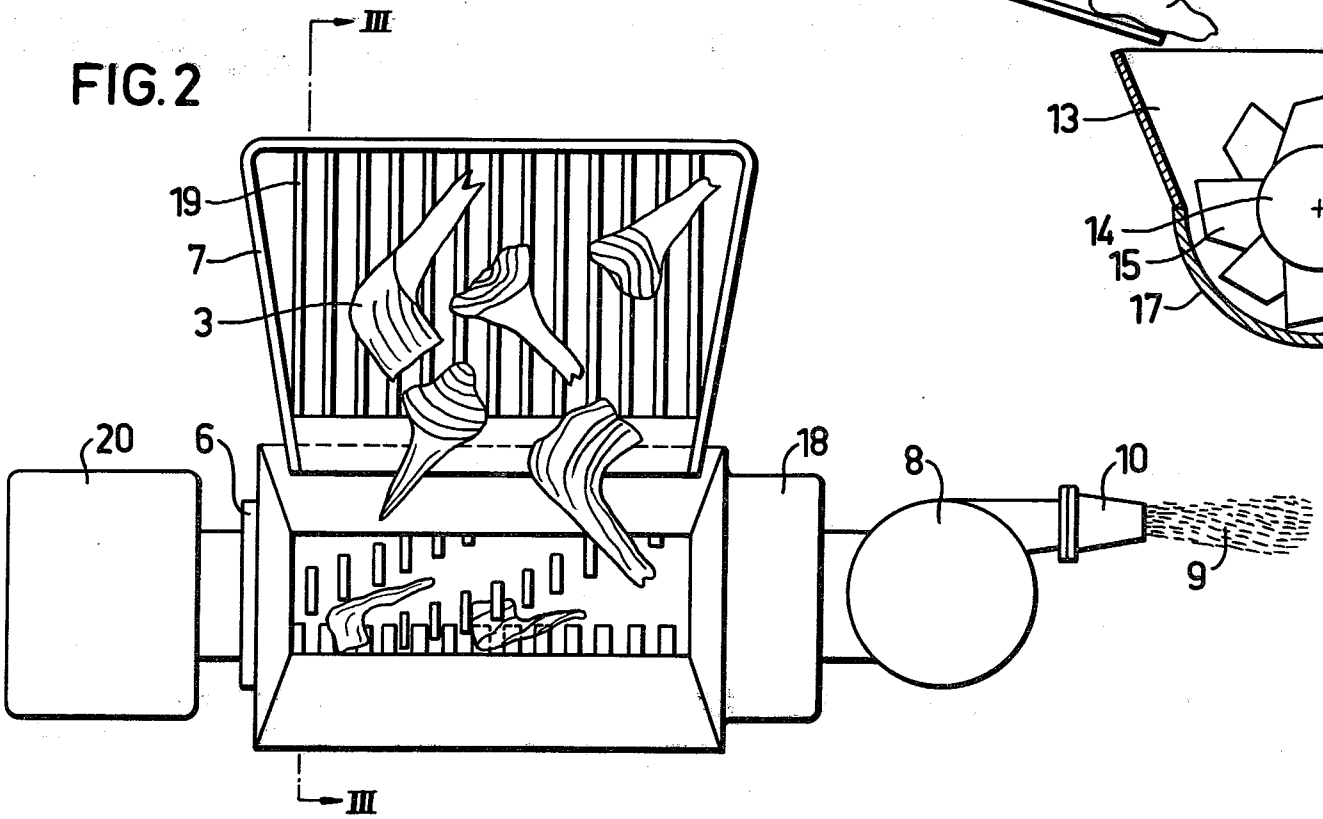
FIG. 2 is a top view of an apparatus according to the invention.
Figure 4:
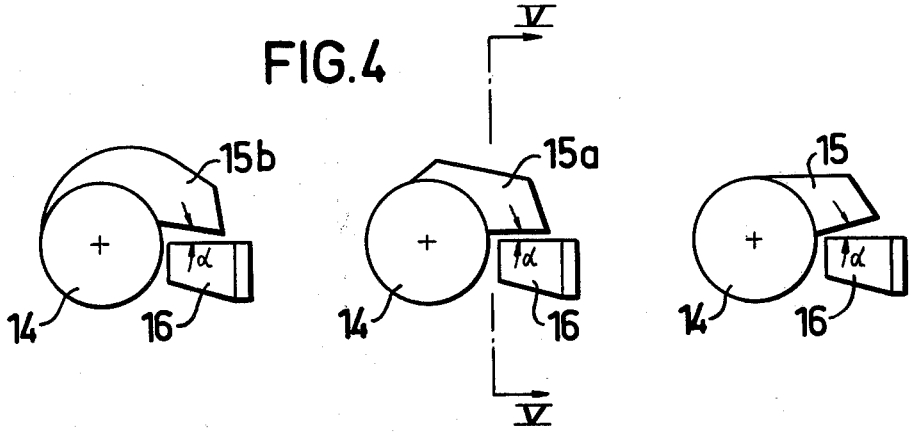
FIG. 4 and 5 is a side view and a section along line V—V in FIG. 4, respectively illustrating various forms of rotor knives arranged in an apparatus according to the invention.

As is evident from FIG. 4 the crushing surfaces edge of the rotor blades 15, 15*a*, 15*b*, resp., can have different angles of action $\alpha$ relative to the crushing surfaces of the stator blades 16, viz, as shown for the rotor blades 15*b* an angle $\alpha$ directed towards the rotor 14 when the crushing surfaces pass for the rotor knife 15*a* an angle $\alpha=0$ and for the rotor knife 15 an angle $\alpha$ directed away from the rotor.

Figure 5:
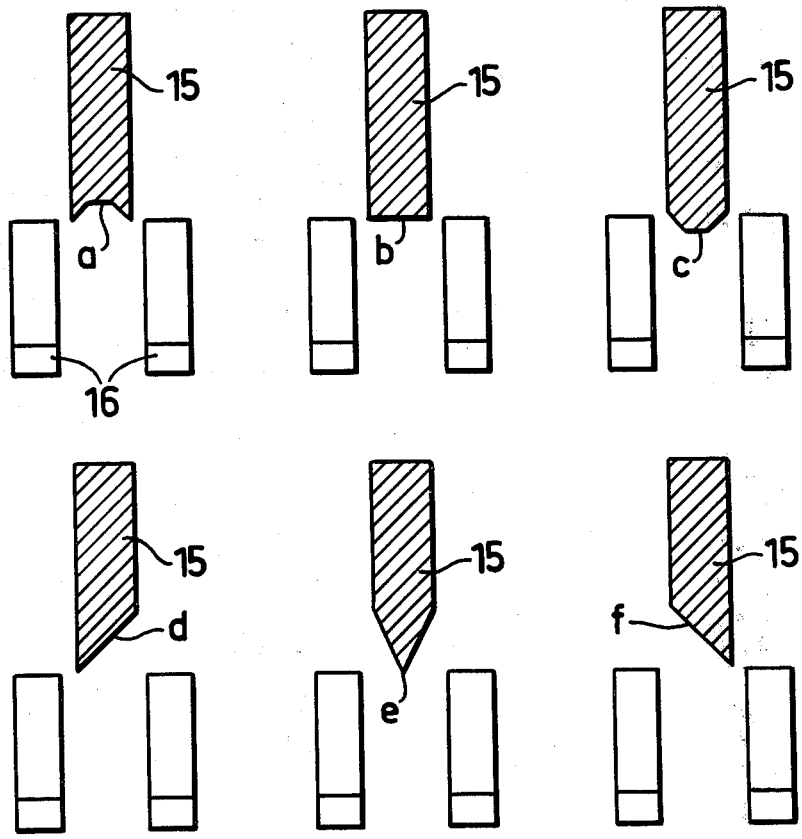

As is evident from FIG. 5 also the crushing surfaces of the rotor blades 15 can have a different shape, viz. as shown at a by a groove have two pointed cutting edges, at b have a straight cutting shape, at c by double chamfers have straight narrower cutting edges, at d by a chamfer have one pointed cutting edge at one side, at e by double chamfers have one pointed cutting edge centrally positioned, and at f by a chamfer have one pointed cutting edge positioned at the opposite side relative to d.

The present invention is not limited to the embodiment described above and shown on the drawings, but can be varied in several ways within the scope of the following claims. Thus, a conveyor can for instance be arranged as a discharge device for conveying the crushed chips from the crush mill. Moreover, means can be arranged for controlling the number of stumps fed into the crush mill, for instance means for switching off temporarily the vibration of the feed table.

We claim:

1. A mill for crushing tree stumps comprising a rotor housing, a rotor mounted for rotation in said housing about a substantially horizontal axis, drive means for rotating said rotor, a plurality of rotor blades spaced along the rotor on a helical path, a plurality of stator blades spaced substantially axially along the housing interior, rotation of the rotor causing said rotor blades to pass between pairs of said stator blades to crush stump material therebetween and liberate foreign matter from the resulting crushed material, with the helical disposition of said rotor blades causing said crushed material and liberated foreign matter to advance substantially axially along said housing toward one end thereof, and means for discharging said crushed material and liberated foreign matter from said one end of said housing.

2. A mill as claimed in claim 1 including a vibratory delivery device for feeding tree stumps into said housing.

3. A mill as claimed in claim 2 wherein said delivery device has a support surface inclined downwardly toward said housing.

4. A mill as claimed in claim 2 wherein said delivery device comprises a plurality of spaced bars defining a tree trunk supporting surface.

5. A mill as claimed in claim 1 wherein said rotor blades and said stator blades have respective crushing surfaces between which the stump material is crushed, the crushing surfaces of the rotor blades forming an angle with the crushing surfaces of the stator blades as the rotor blades pass therebetween.

6. A mill as claimed in claim 1 wherein said rotor blades each have a crushing surface defining at least one cutting edge.

* * * * *